US005263715A

United States Patent [19]

Matsumoto et al.

[11] Patent Number: 5,263,715

[45] Date of Patent: Nov. 23, 1993

[54] DICE DISPLAYING APPARATUS FOR A COMPUTER GAME MACHINE

[75] Inventors: Shigekazu Matsumoto; Hiroyoshi Hashimoto, both of Matto, Japan

[73] Assignee: Irem Corporation, Osaka, Japan

[21] Appl. No.: 955,200

[22] Filed: Oct. 5, 1992

[51] Int. Cl.[5] ..... A63F 9/04; A63F 9/24

[52] U.S. Cl. ..... 273/138 A; 273/85 G; 273/145 R; 273/146; 273/148 B; 273/433

[58] Field of Search ..... 273/138 R, 138 A, 145 R, 273/146, 148 B, 433, 434, 85 CP, 85 G

[56] References Cited

U.S. PATENT DOCUMENTS

| | | | |
|---|---|---|---|
| 3,709,499 | 1/1973 | Lukens, Jr. | 273/138 A |
| 4,188,779 | 2/1980 | Fatton | 273/138 A X |
| 4,506,890 | 3/1985 | Murry | 273/85 CP X |
| 5,031,913 | 7/1991 | Hirosumi et al. | 273/138 A X |
| 5,031,914 | 7/1991 | Rosenthal | 273/138 A X |

FOREIGN PATENT DOCUMENTS 8804189 6/1988 World Int. Prop. O. ..... 273/85 G

*Primary Examiner*—V. Millin
*Assistant Examiner*—Raleigh W. Chiu
*Attorney, Agent, or Firm*—Nikaido, Marmelstein, Murray & Oram

[57] ABSTRACT

A dice displaying apparatus for a computer game machine includes a trackball operable by each player. Rolling speeds of two dice are derived from an amount and direction of operation of the trackball. Rolling angles of the dice are also derived from the amount and direction of operation of the trackball, with slight angles derived from random numbers added thereto. Display positions for the respective dice are determined every predetermined intervals of time from the rolling speeds and rolling angles. Image patterns of varied phases of rolling dice corresponding to the rolling angles are presented in the respective display positions on CRT displays.

8 Claims, 9 Drawing Sheets

DICE DISPLAYING APPARATUS FOR A COMPUTER GAME MACHINE

BACKGROUND OF THE INVENTION (1) Field of the Invention

The present invention relates to a computer game machine for displaying images of dice.

(2) Description of the Related Art

In most game machines that display images of dice on a screen, such as mahjong game machines, the dice are controlled by push button switches.

However, pressing a push button switch is far from the feeling of "throwing dice" and does not provide a sense of reality. Game machines that offer "simulation games" allowing the player to enjoy situations similar to real operating conditions are popular and in increasing demand today. This goes for game machines that display dice on a screen. With this type of machine also, the feeling of "throwing dice" is desired, which will add value to the game machine.

SUMMARY OF THE INVENTION

The present invention has been made having regard to the state of the art noted above, and its object is to provide a dice displaying apparatus for a computer game machine which gives a psuedo-real feeling of "throwing dice".

The above object is fulfilled, according to the present invention, by a dice displaying apparatus for a computer game machine comprising:

a trackball for controlling die means;

detecting means for detecting an amount and direction of operation of the trackball;

display position operating means for deriving a rolling angle and rolling speed of the die means from the amount and direction of operation detected by the detecting means, and determining a die display position from the rolling angle and the rolling speed every predetermined interval of time;

image memory means for storing image patterns of each side of the die means expressing varied phases of rolling movement thereof at a plurality of rolling angles;

display control means for selectively reading the image patterns of the varied phases of rolling movement from the image memory means based on the rolling angle derived by the display position operating means, and outputting an image pattern selected to the die display position; and display means for displaying the image patterns of the die means.

According to the present invention, a rolling angle and rolling speed of each die are derived from an amount and direction of operation of the trackball, and a die display position is determined from the rolling angle and the rolling speed every predetermined interval of time. Then, an image pattern corresponding to the rolling angle of the die is read from the image memory means and outputted to the display position. By continually repeating this operation, the display means presents rolling movement of each die corresponding to the amount and direction of operation of the trackball. As is well known, an operation of the trackball involves a hand motion common to an act of "throwing dice". Thus, the trackball operation provides a pseudo-real feeling of "throwing dice". In addition, since the dice in rolling movement are displayed in response to the amount and direction of trackball operation, that feeling of "throwing dice" takes a visual form also.

In a preferred embodiment of the invention, the display position operating means has a function to determine the die display position by adding a slight angle derived from a random number to the rolling angle of each die.

Since a slight angle derived from a random number is added to the rolling angle of each die derived, the rolling direction of the die may change slightly from time to time even if the trackball is operated in one direction. As is well known, actual dice are cube-shaped, and their rolling direction is not fixed but varies from time to time even when the dice are thrown in the same direction. This apparatus is capable of presenting dice by taking into account that "the rolling direction of dice is variable even if the dice are thrown in the same direction." This promotes the visual effect of dice throwing feeling.

BRIEF DESCRIPTION OF THE DRAWINGS

For the purpose of illustrating the invention, there is shown in the drawings one embodiment which is presently preferred, it being understood, however, that the invention is not limited to the precise arrangements and instrumentalities shown.

DETAILED DESCRIPTION OF THE PREFERRED EMBODIMENT

A preferred embodiment of the present invention will be described in detail hereinafter with reference to the drawings.

Figure 1:
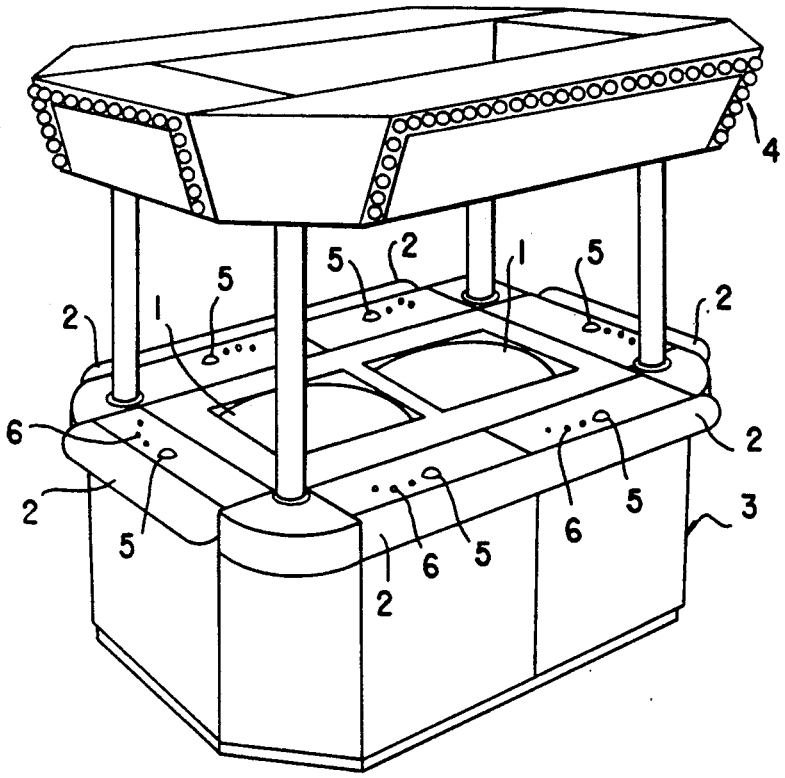
FIG. 1 is a perspective view of a computer game machine according to the present invention.

FIG. 1 is a perspective view showing an outward appearance of a game machine in one embodiment of the present invention.

This game machine provides a mechanized version of "craps" which, along with poker, blackjack and roulette, is a typical game played in casinos.

In the game of craps, players place bets in desired positions on a craps table on which a layout is printed, two dice are thrown on the table, and the total number shown by the dice and the odds afforded by the positions in which the bets are placed determine wins and losses. The role to throw the dice (the thrower is called the shooter) is changed from one player to another in rotation.

This game machine includes two CRT displays 1 disposed centrally thereof for displaying the same image as the layout of the craps table and dice presented by computer graphics, and six control panels 2 arranged around the CRT displays 1 to accommodate six players. The CRT displays 1 and control panels 2 constitute a game deck 3. The game machine further includes an illuminating table 4 supported on four columns over the game deck 3. Though not shown, the illuminating table 4 has spotlights for illuminating particular players.

Each control panel 2 includes a trackball 5 for controlling the dice, a BET button 6 for betting coins or medals, a payoff return, not shown, for paying out coins or medals, and a speaker, also not shown, for producing a sound effect.

Figure 2:
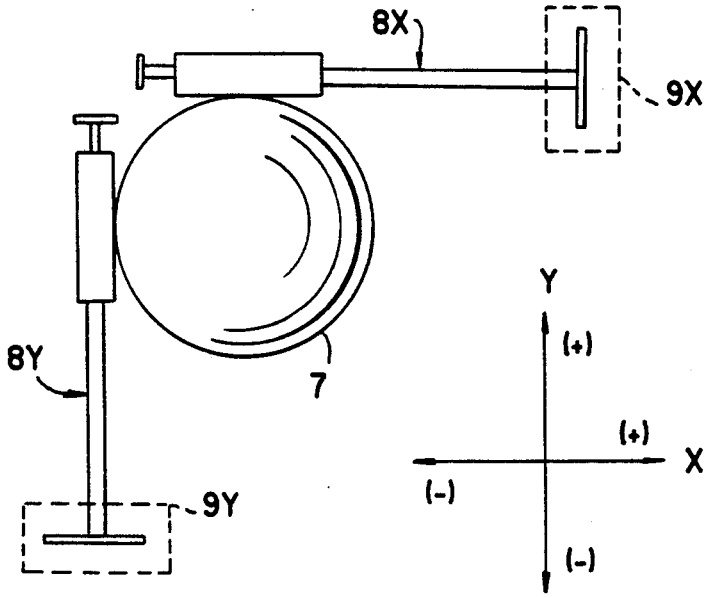
FIG. 2 is a schematic plan view of a trackball.

As schematically shown in FIG. 2, the trackball 5 includes a rolling ball 7 operable by a player and having an illuminating light (not shown), a rotary shaft 8X in contact with the ball 7 and extending in a horizontal direction (X-axis direction) to be rotatable with the ball 7, and a rotary shaft 8Y in contact with the ball 7 and extending in a vertical direction (Y-axis direction) to be rotatable with the ball 7. The rotary shafts 8X and 8Y have detectors 9X and 9Y for detecting the number and direction of rotations thereof, respectively.

As shown in FIG. 2, each of the detectors 9X and 9Y includes a disc 10 mounted on the rotary shaft 8X or 8Y and defining slits 12 and 13 displaced from each other circumferentially of the disk 10. A light emitting diode 14 and photodiodes D1 and D2 are arranged opposite each other across the slits 12 and 13. These detectors 9X and 9Y further include an X-counter 30 and a Y-counter 31, respectively, for counting the number of output signals from the photodiodes D1 and D2.

The X-counter 30 and Y-counter 31 are connected to a CPU 15 mounted in each control panel 2. Though not shown in FIG. 3, the BET button 6, the speaker and other components are also connected to the CPU 15. The CPU 15 is connected through a communication line 16 to a main CPU 17.

Other components connected to the main CPU 17 include a ROM 18 storing programs of the game, a RAM 19 for storing various data derived in the course of play, an image database 20 storing image patterns of dice to be described later, display memories 21 and 22 corresponding to the two CRT displays 1, and a random number generator 23 for generating random numbers in 10 decimal digits.

The random number generator 23 derives a random number Xi from a general formula "$Xi \leftarrow [aX(i-1)+C]\text{mod}\cdot m$". In this formula, signs "a", "C" and "m" represent constants selected at option, and sign "$X(i-1)$" represents an immediately preceding random number. Constants "a", "C" and "m" are selected so that the random number Xi derived each time has a different value and that all available values of the random number are evenly used.

The way in which the above game machine displays the dice will be described next.

Figure 4:
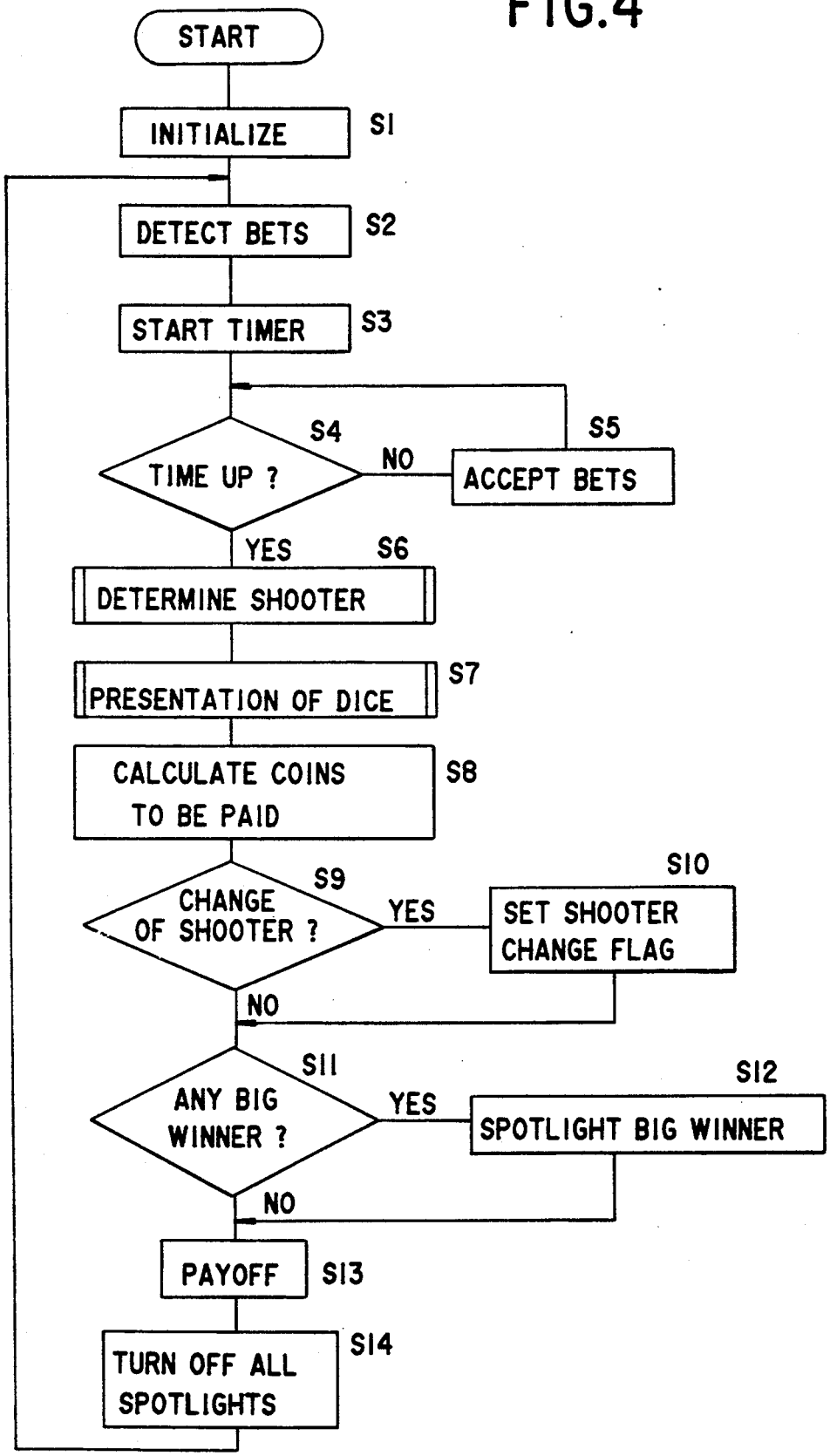
FIG. 4 is a flowchart of a game processing sequence of the computer game machine shown in FIG. 1.

An entire game playing sequence will be described first with reference to the flowchart of FIG. 4.

At step S1, a shooter change flag is set by way of initialization.

At step S2, bets are detected. Each player, after inserting a medal or medals into the game machine, operates the trackball 5 and presses the BET button 6 to place the medal or medals in a desired position as a stake. This is a betting action, and which control panels 2 are taking part in the game is determined by detecting the bets.

After the bets are detected, step S3 is executed to start a "7 to 20 seconds" timer. During this period, any additional bets are accepted (steps S4 and S5), thus admitting further participants into the game.

Once the participants are determined, step S6 is executed to select the shooter (the player to throw the dice by operating the trackball 5). Then, the selected shooter is indicated by turning on the spotlight in the illuminating table 4 to illuminate the shooter, and at the same time lighting the trackball 5 on the control panel 2 of the shooter.

At step S7, two rolling dice are presented on the CRT displays 1 in response to the rolling direction and speed of the trackball 5 manipulated by the shooter. Processing for this dice presentation will be described later.

At step S8, the number of medal or coils to be paid to each player is calculated from the total number shown by the two dice and the odds afforded by the bet position on the craps table.

At step S9, whether the shooter is to be changed or not is determined from the total number shown by the two dice (the rule for this decision being immaterial and not described herein). The operation moves to step S10 to set the shooter change flag as necessary, before moving to step S11. If the same player is allowed to continue as the shooter, step S11 is executed without setting the shooter change flag.

At step S11, whether there is any big winner or not is determined from the numbers of coins calculated for payment and a predetermined reference number of coins. If there is, step S12 is executed to emphasize the big winner by illuminating him or her with the spotlight in the illuminating table 4. At step S13, coins are paid to winners for settlement. This settlement is carried out by displaying the number of coins paid on a digital display provided on each control panel, and dispensing the coins through the payoff return of the game machine when the player quits the game or upon completion of each play. The settled or lost bets are cleared.

At step S14, the spotlight and sound effect are turned off. Then the operation returns to step S2 to wait for bets.

The dice presentation processing carried out at step S7 above will be described next with reference to the flowchart of FIG. 5. This processing is carried out by the main CPU 17.

Figure 6:
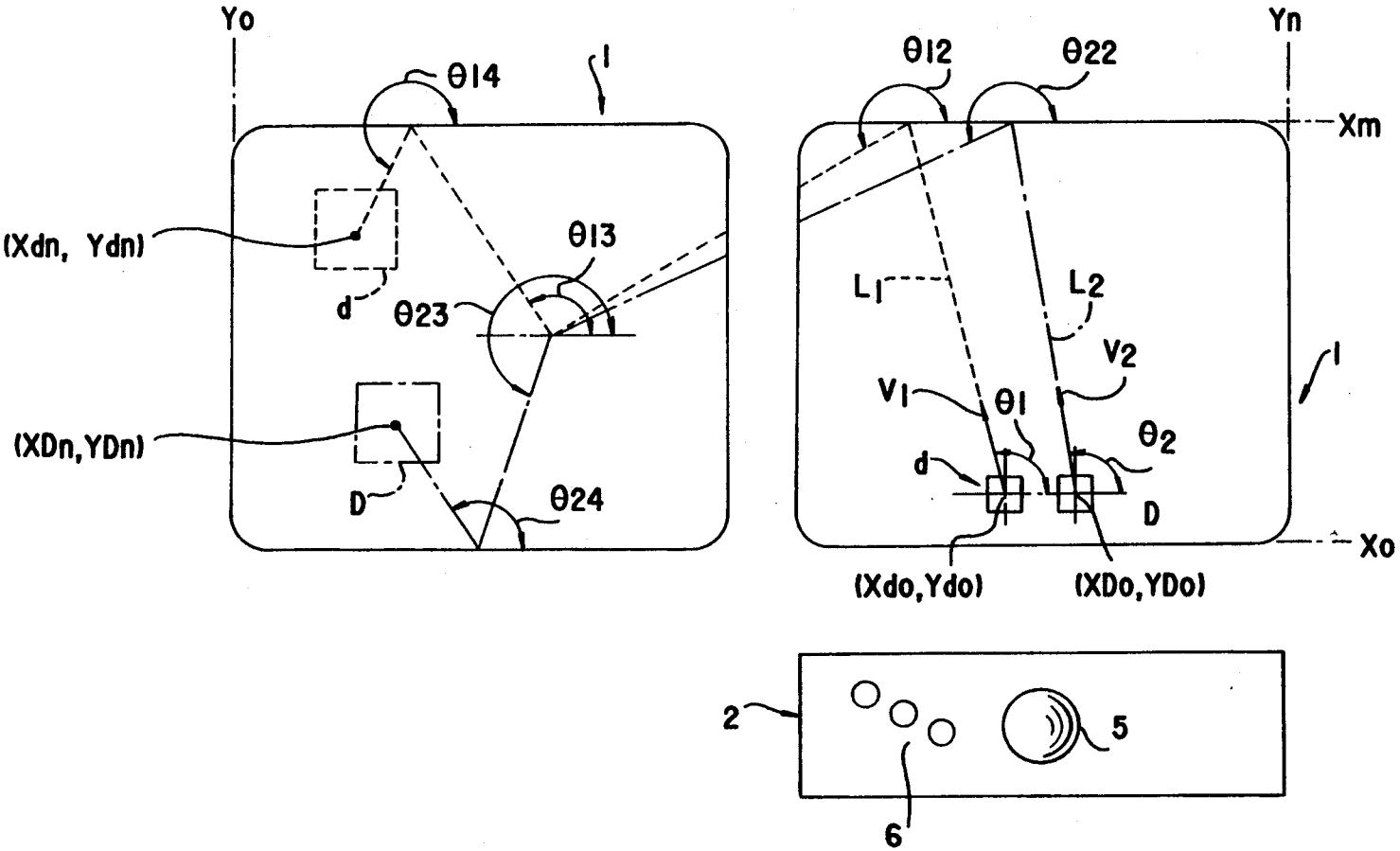
FIG. 6 is a plan view of the computer game machine showing rolling tracks of dice.

At step S71, images of two dice d, D appear in positions on the CRT display 1 adjacent the control panel 2 of the selected shooter (see FIG. 6). FIG. 6 is a schematic plan view of the game deck 3 shown in FIG. 1, with only one control panel 2 shown for expediency.

Figure 3:
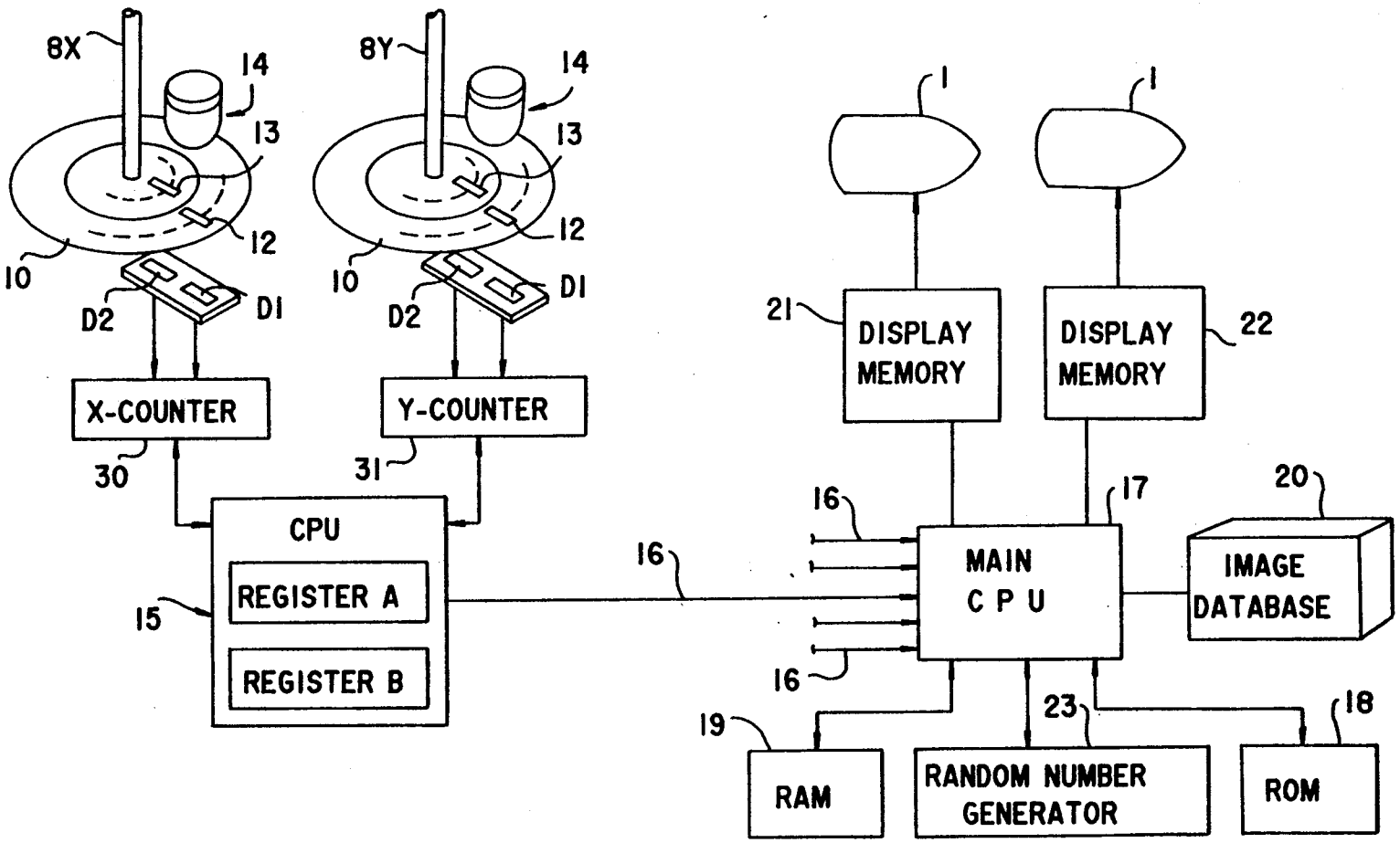
FIG. 3 is a schematic block diagram of a dice displaying apparatus according to the present invention.

The images of dice displayed are read from the image database 20 shown in FIG. 3 and transferred to the display memory 21 or 22.

The image database 20 stores;

(1) six image patterns corresponding to the numbers shown on the sides of each die, (2) twelve image patterns corresponding to varied phases of each side of each die making one rotation, and (3) twelve image patterns expressing varied directions of rotation of each die.

Thus, the image database 20 stores a total of $864(=6\times12\times12)$ image patterns.

Figure 12:
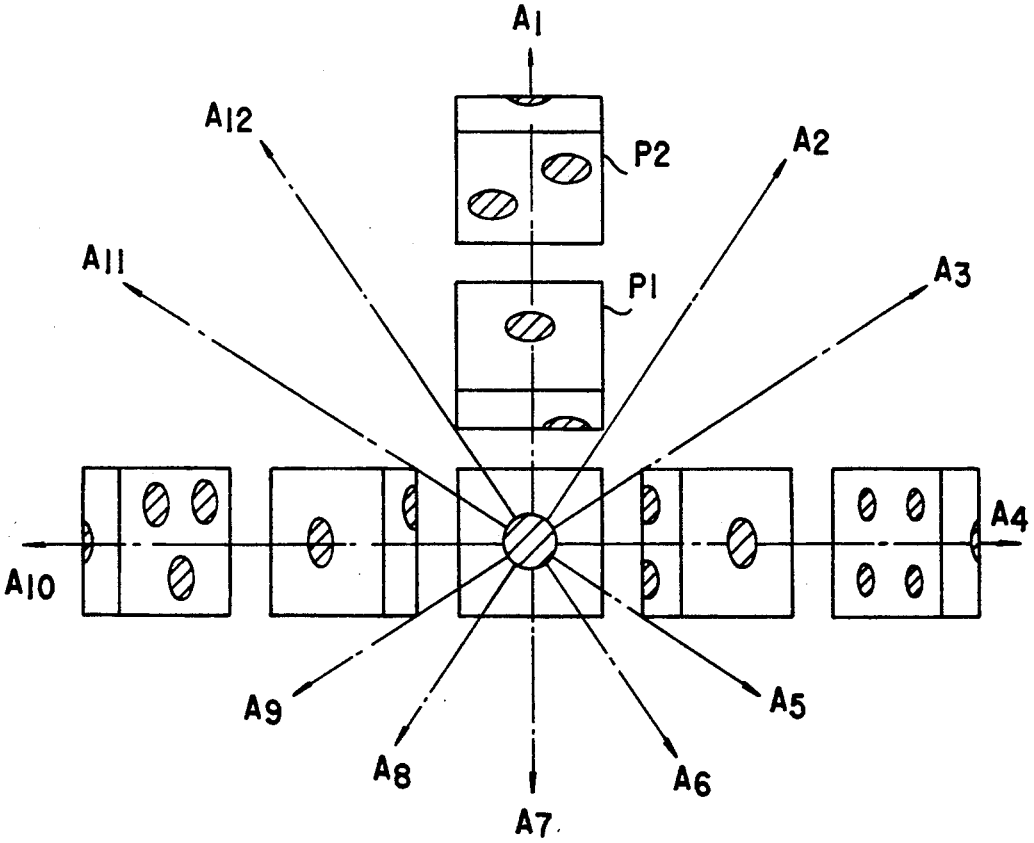
FIG. 12 is a schematic view of image patterns.

Some examples of the image patterns are schematically shown in FIG. 12. FIG. 12 shows part of image patterns relating to a one-dot side of each die. References P1, P2 and so on denote the image patterns of varied phases of the die making one rotation. These image patterns are provided for each of rolling directions A1–A12.

At step S71, the main CPU 17 reads the image patterns of sides of the dice facing up the previous time (or of any sides if this is going to be a come-out roll), and transmits these image patterns to the display memory 21 or 22 for presentation on the CRT display 1. The coordinate positions for presentation on the CRT displays 1 are predetermined in relation to the respective control panels 2. As shown in FIG. 6, for example, it is assumed that the die d has a coordinate position (Xd0, Yd0) for presentation, and the die D a coordinate position (XD0, YD0) for presentation, both in relation to the particular control panel 2.

Figure 7:
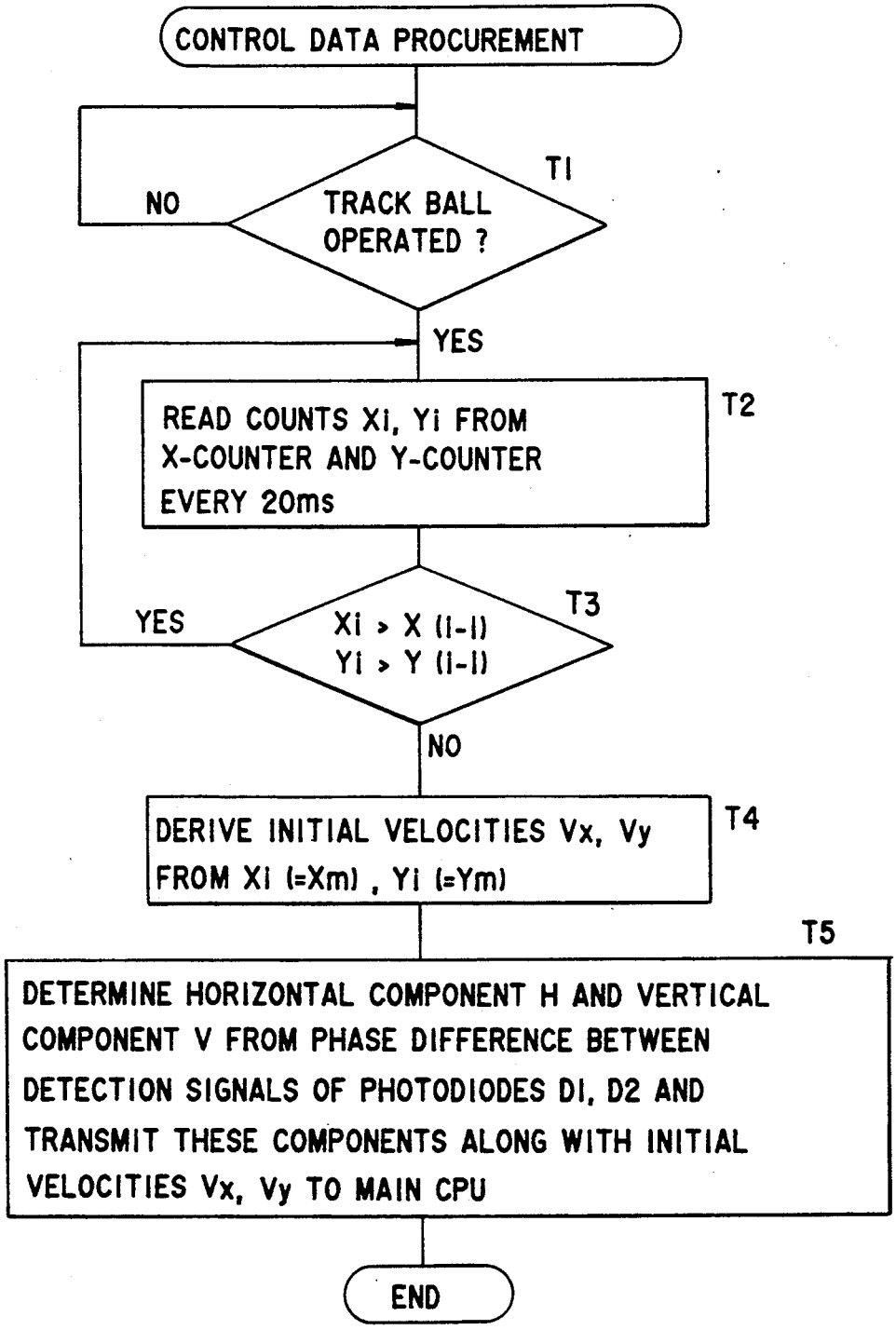
FIG. 7 is a flowchart of a sequence for procurement of trackball control data (amounts and direction of operation)

At step S72, a three-second timer is started. Then, it is determined whether or not the shooter operates the trackball 5 within the three seconds to cause the CPU 15 in the control panel 2 to output control data, that is whether or not the main CPU 17 receives the control data within the three seconds (step S73). Here, the control data output processing by the CPU 15 will be described with reference to the flowchart of FIG. 7.

When the CPU 15 in the control panel 2 determines at step T1 that the trackball 5 has been operated, the CPU 15 executes step T2. At this step, the CPU 15, after starting a 20 ms timer, reads counts Xi and Yi from X-counter 30 and Y-counter 31 and resets these counters every 20 ms. At step S3, the CPU 15 compares current counts "Xi", "Yi" and immediately preceding counts "X(i−1)", "Y(i−1)".

The comparison is made by using a register A and a register B included in the CPU 15 (see FIG. 3). The immediately preceding counts "X(i−1)" and "Y(i−1)" are recorded in the registers A and B, respectively, for comparison with the current counts "Xi" and "Yi". If Xi is greater than X(i−1) and Yi greater than Y(i−1), the contents of registers A and B are renewed with "Xi" and "Yi". This operation is repeated until Xi>X(i−1) and Yi>Y(i−1) are negated.

Figure 8:
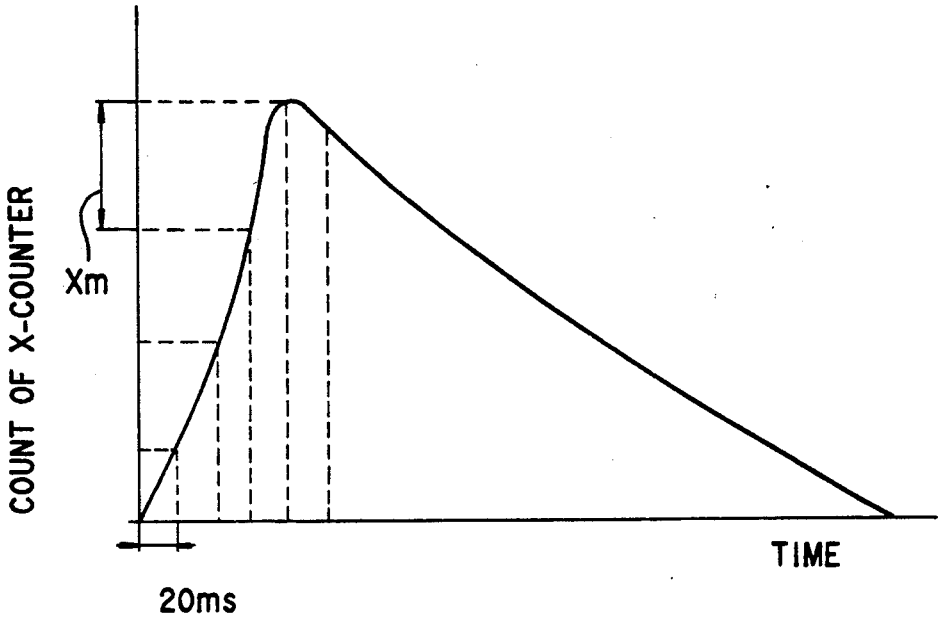
FIG. 8 is graph showing a relationship between amount of trackball operation (count of a counter) and time.

FIG. 8 shows, by way of example, a relationship between count of the X-counter 30 and time when the trackball 5 is operated. As a result of repeating steps T2 and T3 above, count Xi recorded in the register A ultimately reaches a maximum count Xm as shown. Similarly, count Yi recorded in the register B ultimately reaches a maximum count Ym. In this embodiment, the maximum counts Xm and Ym of the X-counter 30 and Y-counter 31 have an upper limit set to "140" and a lower limit set to "20". That is, the maximum counts range from "20" to "140", and counts less than "20" indicate that the trackball 5 has not been operated.

Step T4 is executed to derive an initial velocity Vx in the X-direction of the trackball 5 from the value Xm, and an initial velocity Vy in the Y-direction of the trackball 5 from the value Ym. Since the values Xm and Ym are counts obtained in the time interval of 20 ms, the initial velocity Vx per 1 ms is expressed by "Xm/20" and the initial velocity Vy per 1 m by "Ym/20".

At step T5, a horizontal component H (H="+" or "−") is determined from a phase difference between output signals of the photodiodes D1 and D2 of the detector 9X, and a vertical component V (V="+" or "−") is determined from a phase difference between output signals of the photodiodes D1 and D2 of the detector 9Y. Directional components "+ and −" are set with respect to the horizontal direction (X) and vertical direction (Y) as shown in FIG. 2. This arrangement is set such that the vertical direction (Y) has the "+" side extending from the trackball 5 toward the CRT displays 1.

Thus, clockwise rotation of the rotary shafts 8X and 8Y corresponds to rotation in "+" direction, and counterclockwise rotation thereof to rotation in "−" direction. At this time, the slit 13 formed in the disc 10 attached to each rotary shaft 8X or 8Y first passes across an optical path of the light emitting diode 14, whereby the output signal of the photodiode D2 has a leading phase with respect to that of the photodiode D1. The directional components of the trackball 5 are determined from such differences in phase.

The main CPU 17 receives data of the initial velocities Vx and Vy derived as above, and the horizontal component H and vertical component V determined. The control data noted hereinbefore refer to these data.

Figure 5:
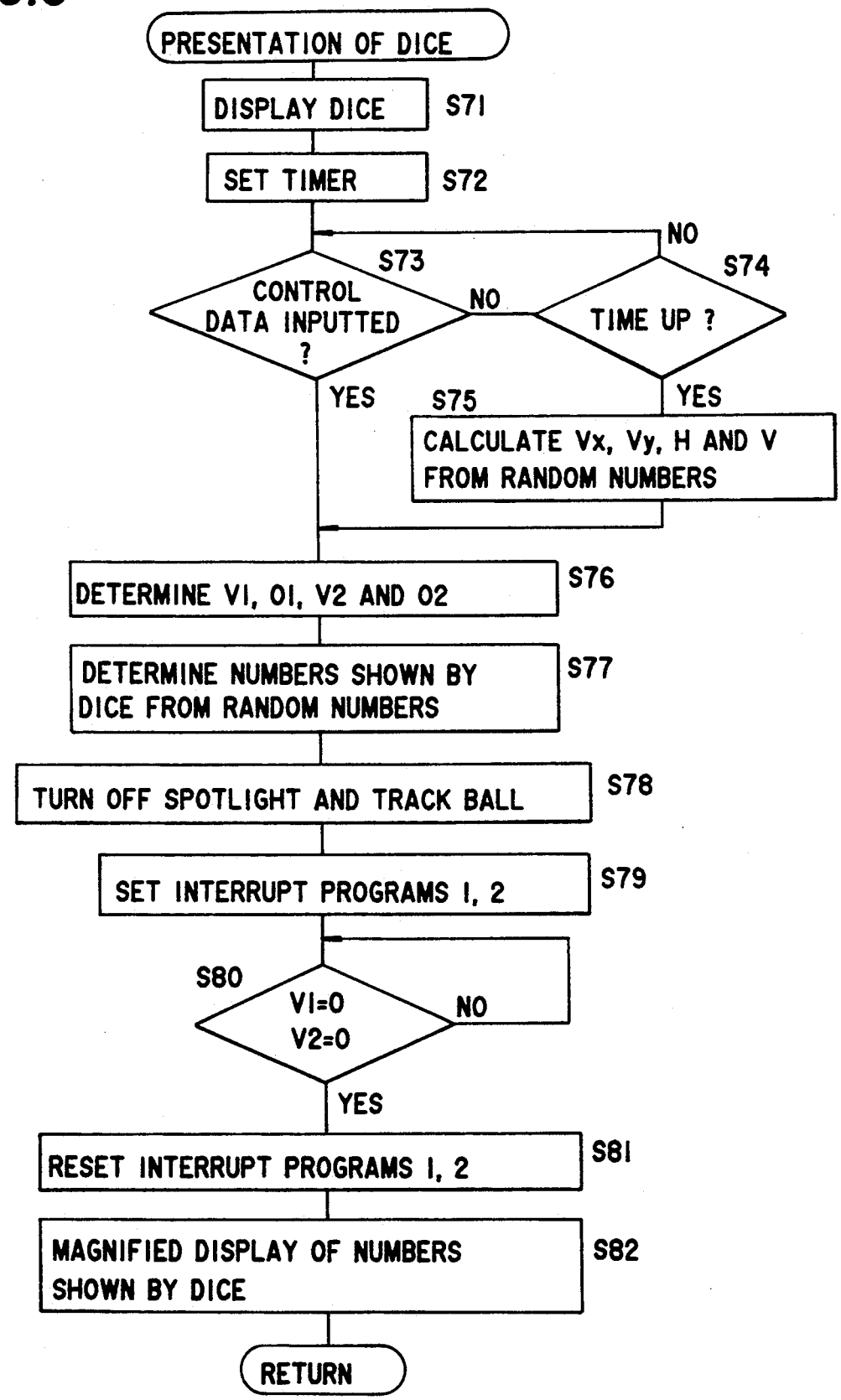
FIG. 5 is a flowchart of a dice presentation subroutine in the flowchart of FIG. 4.

Reverting to the flowchart of FIG. 5, after the control data are inputted to the main CPU 17, the operation moves to step S76. On the other hand, if no control data are inputted within the period of three seconds, that is if the shooter does not operate the trackball 5, the operation moves to step S75 to prepare control data automatically.

At step S75, and 8-digit data is first selected by removing digits at opposite ends of a 10-digit data generated by the random number generator 23, in order to prepare control data including initial velocities Vx and Vy, horizontal component H and vertical component V.

When the selected 8-digit decimal is divided by "240", the remainder takes a value "0 to 239". This is the reason why the division is made by "240". The maximum counts Xm and Ym of the X-counter 30 and Y-counter 31 which provide the initial velocities Vx and Vy, respectively, take values of "20 to 140" as noted hereinbefore. Thus, the range of available values is "0 to 120". With the horizontal component "+ or −" and vertical component "+ or −" added thereto, the ultimate range of values available is "−120 to +120" which correspond to the remainder values of the random number "0 to 239".

Consequently, the initial velocities Vx and Vy may be expressed by using the above remainder values "0 to 239". Here, the remainder values "0 to 119" represent maximum counts "20 to 140" for a plus directional component, while the remainder values "120 to 239" represent maximum counts "20 to 140" for a minus directional component. Subsequently, these maximum counts are divided by 20, as noted hereinbefore, to obtain data of initial velocities Vx and Vy in 1 ms.

Figure 9:
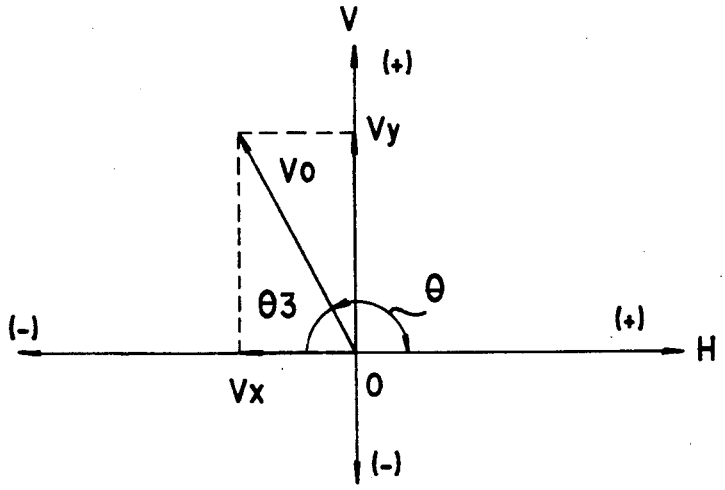
FIG. 9 is an explanatory view showing how a rotating speed and a rotating direction of a trackball are derived.

Assume that, as shown in FIG. 9, the control data inputted at step S73 or the control data prepared at step S75 include a minus directional component Vx and a plus directional component Vy. At the next step S76, a velocity V0 (=V1=V2) and rolling angles $\theta 1$ and $\theta 2$ of the two dice d and D are derived from the control data.

Firstly, the velocity V0 is derived from the following equation (1):

$$V0 = N \times \sqrt{Vx^2 + Vy^2} \quad (1)$$

where N is a predetermined coefficient.

Then, an angle $\theta 3$ between velocity V0 and component Vx, (see FIG. 3) is derived from the following equation (2):

$$\theta 3 = \tan^{-1}(Vy/Vx) \quad (2)$$

Amplitude $\theta$ of the velocity V0 with respect to the horizontal component H is derived from the above angle $\theta 3$ and the signs of horizontal component H and vertical component V, as follows:

when H=(+) and V=(+), amplitude $\theta = \theta 3$, when H=(+) and V=(−), amplitude $\theta = 360 - \theta 3$, when H=(−) and V=(+), amplitude $\theta = 180 - \theta 3$, and when H=(−) and V=(−), amplitude $\theta = 180 + \theta 3$.

In this example, H=(−) and V=(+), amplitude $\theta = 180 - \theta 3$.

This amplitude $\theta$ may be employed as the rolling angles $\theta 1$ and $\theta 2$ of the dice d and D. However, in order to visualize actual rolling modes of the dice thrown, in which the rolling angles of the cube-shaped dice are variable even if the dice are thrown in the same direction, a slight angle $\theta 4$ (e.g. 4 to 10 degrees) obtained from random numbers is added to the amplitude $\theta$ to produce rolling angles $\theta 1$ and $\theta 2$. In this example, the rolling angle $\theta 1$ is amplitude $\theta + \theta 4$, while the rolling angle $\theta 2$ is amplitude $\theta - \theta 4$. The slight angle $\theta 4$ is derived as follows.

Firstly, an 8-digit data is selected by removing digits at opposite ends of a 10-digit data generated by the random number generator 23. The selected 8-digit decimal is divided by "7", to obtain a remainder "0 to 6". Since the slight angle $\theta 4$ may be selected from the range of 4 to 10 degrees, the values of the remainder "0 to 6" are made to correspond to these degrees. Thus, the slight angle $\theta 4$ is 4 degrees when the remainder is "0", 5 degrees when the remainder is "1", . . . , and 10 degrees when the remainder is "6".

The rolling angles $\theta 1$ and $\theta 2$ of the dice d and D are calculated by using the slight angle $\theta 4$ obtained from the random number. Thus, the velocities V1 (=V0) and V2 (=V0) and rolling angles $\theta 1$ and $\theta 2$ of the dice d and D are obtained.

At the step S77, the numbers shown by the dice d and D are determined by using random numbers. The numbers shown by the dice d and D may be from 1 to 6. As in the case of the slight angle $\theta 4$, and 8-digit data is selected by removing digits at opposite ends of a 10-digit data generated by the random number generator 23. The selected 8-digit decimal is divided by "6", to obtain a remainder "0 to 5". The values of the remainder "0 to 5" are made to correspond to the numbers "1 to 6" shown by the dice d and D, thereby to determine the numbers shown by the dice d and D.

At step S78, the spotlight illuminating the shooter and the light of his or her trackball 5 are turned off.

Figure 10:
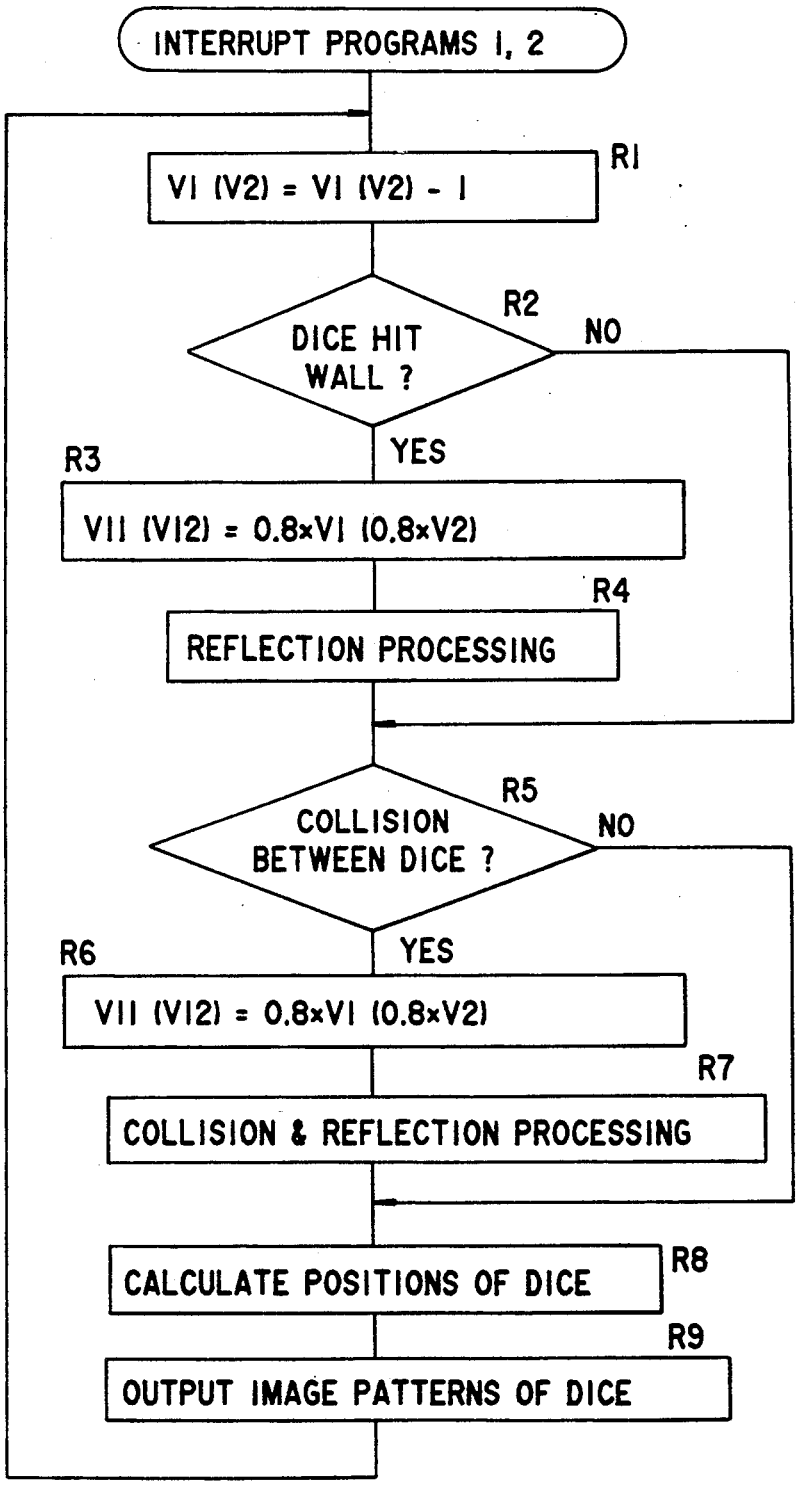
FIG. 10 is a flowchart of interrupt programs 1, 2 included as a subroutine in the flowchart of FIG. 5.

At step S79, interrupt programs 1 and 2 are set every 16 ms to display the dice d and D in rolling movement on the CRT displays 1, based on the velocities V1 and V2 and rolling angles $\theta 1$ and $\theta 2$ of the dice d and D. The interrupt program 1 relates to display processing for the die d, while the interrupt program 2 relates to display processing for the die D. The interrupt programs 1 and 2 are executed until the velocities V1 and V2 of the dice d and D become zero, i.e. until the dice d and D stop rolling on the CRT displays 1 (steps S80 and S81). The sequence of the interrupt programs 1 and 2 will be described with reference to the flowchart of FIG. 10.

The interrupt programs 1 and 2 are programs that repeatedly calculate coordinate positions on the CRT displays 1 for diplaying the dice d and D, and selectively read image patterns of the dice d and D from the image database 20.

At step R1, "1" is subtracted from the velocities V1 and V2 of the dice d and D.

At step R2, checking is made whether the dice d and D have hit a wall. If they have, the operation moves to steps R3 and R4 to obtain subsequent velocities V1 and V2 and rolling angles $\theta 1$ and $\theta 2$ of the dice d and D.

At step R5, checking is made whether the dice d and D have collided with each other. If they have, the operation moves to steps R6 and R7 to obtain subsequent velocities V1 and V2 and rolling angles $\theta 1$ and $\theta 2$ of the dice d and D.

It is impossible for the dice d and D to hit a wall (an end of the CRT displays 1) or to collide with each other upon execution for the first time of the interrupt programs 1 and 2, i.e. only 16 ms from throwing of the dice d and D. Assuming, therefore, that step R5 gives an answer "NO", calculation of coordinate positions made at step R8 for displaying the dice d and D will be described.

The velocities V1 and V2 and rolling angles $\theta 1$ and $\theta 2$ of the dice d and D remain the same in the absence of a collision. Thus, display coordinates are derived, as follows, from the velocities V1 and V2 and rolling angles $\theta 1$ and $\theta 2$ of the dice d and D obtained at step S76 in the flowchart of FIG. 5.

Figure 11:
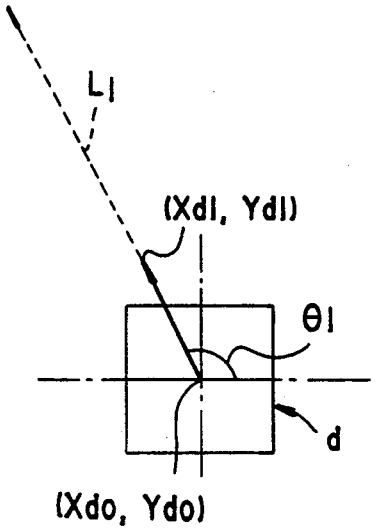
FIG. 11 is an explanatory view showing how a die displaying coordinate position is derived.

As shown in FIG. 11, initial display coordinates for the die d are (Xd0, Yd0). The die d may move in the direction of rolling angle $\theta 1$ in 16 ms to a position of display coordinates (Xd1, Yd1) which are derived from the following equations (3) and (4):

$$Xd1 = 16[ms] \times Vo \cos \theta 1 \quad (3)$$

$$Yd1 = 16[ms] \times Vo \cos \theta 1 \quad (4)$$

Similarly, display coordinates (XD1, YD1) for the die D are derived from the following equations (5) and (6):

$$XD1 = 16[ms] \times Vo \cos \theta 2 \quad (5)$$

$$YD1 = 16[ms] \times Vo \cos \theta 2 \quad (6)$$

Next, at step R9, image patterns of the dice d and D are read from the image database 20 and transferred to the display memories 21 and 22 for presentation in the calculated coordinate positions on the CRT displays 1.

As noted hereinbefore, the image patterns of the dice d and D include (1) six image patterns corresponding to the numbers shown on the sides of each die, (2) twelve image patterns corresponding to varied phases of each side of each die making one rotation, and (3) twelve image patterns expressing varied directions of rotation of each die.

Firstly, image patterns of rotating directions closest to the rolling angles $\theta 1$ and $\theta 2$ are selected from the twelve image patterns. Next, one phase image pattern of each of the dice d and D in the selected rotating direction is selected. This image pattern is shown in the position of display coordinates calculated. Take the image patterns shown in FIG. 12 for example, an image pattern P1 in the rotating direction A1 closest to the rolling angle θ1 is read and displayed.

The operation then returns to step R1 to repeat the above sequence. Consequently, as shown in FIG. 6, images of the rolling dice d and D are presented that describe loci L1 and L2.

The processing carried out when the dice d and D hit an end of the CRT displays 1 (step R2) will be described next.

Whether the dice d and D hit an end of the CRT displays 1 as shown in FIG. 6 is determined from whether the display coordinates (Xdi, Ydi) and (XDi, YDi) (where "i" is a starting point 0 to a fining point n) of the dice d and D correspond to coordinate positions of that end. If the dice d and D hit the end, the operation moves to step R3. At step R3, the velocities V1 and V2 of the dice d and D are multiplied by "0.8" for deceleration. The velocities after the deceleration are named V11 and V12 herein.

In the reflection or rebound processing carried out at the next step S4, theoretical reflection angles of the dice d and D are first calculated based on the law of reflection. Angles (0 to 10 degrees) derived from random numbers are added to these reflection angles to obtain final reflection angles θ12 and θ22 (see FIG. 6). The angles of 0 to 10 degrees are added because the cube-shaped dice d and D do not always follow the law of reflection. These angles are derived from random numbers in the same way as explained hereinbefore. For each angle, a random number outputted from the random number generator 23 is divided by "11", and values of the remainder "0 to 10" are used. Angles θ14 and θ24 shown in FIG. 6 are also determined in the same way.

The processing carried out when the dice d and D collide with each other (steps R5 to R7) will be described next. It is determined that a collision between the dice has occurred when the display coordinates (Xdi, Ydi) and (XDi, YDi) (where "i" is a starting point 0 to a fining point n) of the dice d and D coincide. Then, the velocities V1 and V2 of the dice d and D are multiplied by "0.8" to obtain velocities V11 and V12 after deceleration (step R6). After obtaining the theoretical reflection angles, angles derived from random numbers are added to the reflection angles as described above, to obtain final reflection angles θ13 and θ23 (see FIG. 6).

The velocities V12 and V22 and reflection angles θ12, θ13, θ14, θ22, θ23 and θ24 obtained above are substituted into the equations (3) through (6) to calculate display coordinates for the dice d and D (step R8).

If step S80 in the flowchart of FIG. 5 finds that the velocities V1 and V2 of the dice d and D are zero (i.e. the dice d and D theoretically have stopped rolling), step S81 is executed to reset the interrupt programs 1 and 2. Then, at step S82, the numbers shown by the dice d and D are displayed in magnification. These numbers are already calculated at step S77. This completes the dice presentation processing (subroutine called at step S7), and the operation repeats step S8 and subsequent steps in FIG. 4.

The present invention may be embodied in other specific forms without departing from the spirit or essential attributes thereof and, accordingly, reference should be made to the appended claims, rather than to the foregoing specification, as indicating the scope of the invention.

What is claimed is:

1. A dice displaying apparatus for a computer game machine comprising:

a trackball for controlling die means;

detecting means for detecting an amount and direction of operation of said trackball;

display position operating means for deriving a rolling angle and rolling speed of said die means from said amount and direction of operation detected by said detecting means, and determining a die display position from said rolling angle and said rolling speed every predetermined interval of time;

image memory means for storing image patterns of each side of said die means expressing varied phases of rolling movement thereof at a plurality of rolling angles;

display control means for selectively reading said image patterns of said varied phases of rolling movement from said image memory means based on said rolling angle derived by said display position operating means, and outputting an image pattern selected to said die display position; and display means for displaying said image patterns of said die means.

2. An apparatus as defined in claim 1, wherein said display position operating means is operable to determine said die display position by adding a slight angle derived from a random number to said rolling angle of said die means.

3. An apparatus as defined in claim 1, wherein said display position operating means is operable to reduce, every predetermined interval of time, said rolling speed of said die means derived from said amount of operation of said trackball.

4. An apparatus as defined in claim 1, wherein said display position operating means is operable to check, based on said die display position determined every predetermined interval of time, whether said die means hits an end (wall) of said display means, to calculate a theoretical reflection angle of said die means according to a law of reflection when said die means hits the wall, and to obtain a final reflection angle by adding a slight angle derived from a random number to said reflection angle.

5. An apparatus as defined in any one of claims 1 to 4, wherein:

said display position operating means is operable to derive rolling angles and rolling speeds of two dice from said amount and direction of operation of said trackball detected by said detecting means, and to determine display positions for the respective dice from said rolling angles and said rolling speeds every predetermined interval of time;

said display control means is operable to selectively read said image patterns of said varied phases of rolling movement of the respective dice from said image memory means based on said rolling angles derived by said display position operating means, and to output said image patterns selected to said display positions, respectively; and display means is operable to display said image patterns of the respective dice in two display positions determined.

6. An apparatus as defined in claim 5, wherein said display position operating means is operable to check, based on said display positions determined every predetermined interval of time, whether said dice collide with each other, to calculate theoretical reflection angles of said dice according to a law of reflection when said dice collide with each other, and to obtain final reflection angles of the respective dice by adding slight angles derived from random numbers to said reflection angles.

7. An apparatus as defined in claim 1, wherein said image memory means stores 6×N×M image patterns including, in combination, six image patterns corresponding to the number shown on sides of said die means, a plurality (N) of image patterns corresponding to varied phases of each side of said die means making one rotation, and a plurality of (M) of image patterns expressing varied directions of rotation of said die means.

8. An apparatus as defined in claim 7, wherein said display control means is operable to select a group of image patterns in the direction of rotation closest to said rolling angle of said die means derived by said display position operating means, from said image patterns stored in said image memory means, to select one image pattern showing a phase of said die means in, rotation from said group of image patterns, and to output said one image pattern to said display position determined by said display position operating means.

* * * * *